US006235185B1

(12) United States Patent
Tanaka et al.

(10) Patent No.: US 6,235,185 B1
(45) Date of Patent: May 22, 2001

(54) METHOD OF AND APPARATUS FOR PRODUCING ULTRAFINE METAL COMPOUND PARTICLES

(75) Inventors: Chikafumi Tanaka; Katsuyuki Tanabe; Shingo Hoshi, all of Uji (JP)

(73) Assignee: Unitika Ltd. (JP)

( * ) Notice: Subject to any disclaimer, the term of this patent is extended or adjusted under 35 U.S.C. 154(b) by 0 days.

(21) Appl. No.: 09/340,587

(22) Filed: Jun. 28, 1999

(30) Foreign Application Priority Data

Jun. 29, 1998 (JP) ..... 10-181979

(51) Int. Cl.[7] ..... C25B 15/08

(52) U.S. Cl. ..... 205/508; 205/509; 205/538; 204/252

(58) Field of Search ..... 204/252; 205/508, 205/509, 538

(56) References Cited

U.S. PATENT DOCUMENTS

| | | | | |
|---|---|---|---|---|
| 2,832,728 | | 4/1958 | Kunin . | |
| 3,506,560 | | 4/1970 | Grangaard . | |
| 4,067,788 | | 1/1978 | Solomon . | |
| 4,422,910 | | 12/1983 | Scholz et al. . | |
| 4,439,293 | * | 3/1984 | Vuaghan | 205/99 |
| 5,118,399 | * | 6/1992 | Vaughan | 204/520 |
| 5,198,085 | | 3/1993 | Vaughan . | |
| 5,384,017 | | 1/1995 | Lumbroso . | |

FOREIGN PATENT DOCUMENTS

| | | | |
|---|---|---|---|
| 585207A1 | * | 3/1994 | (EP) . |
| 0585207A1 | | 3/1994 | (EP) . |
| 2253860 | | 9/1992 | (GB) . |
| 2287718 | | 9/1995 | (GB) . |

* cited by examiner

*Primary Examiner*—Arun S. Phasge
(74) *Attorney, Agent, or Firm*—Harness, Dickey & Pierce, P.L.C.

(57) ABSTRACT

There are provided a method of and an apparatus for producing ultrafine metal compound particles. An electrolytic bath having an anode and a cathode is partitioned into chambers by at least one ion exchange layer. An electrolytic solution containing metal ions as a starting material for the ultrafine metal compound particles is contained in a chamber on the anodic side of one ion exchange layer, and an alkaline electrolytic solution is contained in a chamber on the cathodic side of the ion exchange layer. When a voltage is applied between the anode and the cathode, the metal ions transfer from the anodic side chamber to the cathodic side chamber through the ion exchange layer, whereby ultrafine metal compound particles are precipitated in the alkaline electrolytic solution in the cathodic side chamber.

12 Claims, 9 Drawing Sheets

100nm

METHOD OF AND APPARATUS FOR PRODUCING ULTRAFINE METAL COMPOUND PARTICLES

FIELD OF THE INVENTION

The present invention relates to a method of and an apparatus for producing ultrafine metal compound particles having diameters of not greater than 1 μm and, more particularly, to a method of and an apparatus for producing ultrafine particles of a metal oxide, a metal hydroxide or a mixture thereof.

BACKGROUND OF THE INVENTION

Exemplary methods hitherto known for production of ultrafine metal oxide particles having diameters of not greater than 1 μm include hydrolysis of a metal alkoxide and utilization of an interface of liquid and plasma generated by electrolysis as disclosed in JP-B-6-86285.

Exemplary methods hitherto known for production of ultrafine metal hydroxide particles having diameters of not greater than 1 μm include precipitation such as co-precipitation and hydrolysis of a metal alkoxide.

In the method involving the hydrolysis of a metal alkoxide, ultrafine oxide particles are obtained by dissolving the metal alkoxide as a starting material in a large amount of alcohol, then adding water and a catalyst to the resulting solution, and subjecting the alkoxide to hydrolysis and subsequent polycondensation.

In the method utilizing an interface of liquid and plasma generated by electrolysis, ultrafine particles including oxide particles are obtained by reacting ions leaching out of an anode material with oxygen ions in the interface of the liquid and plasma generated by electrical breakdown of a gas occurring on a cathode.

In the method of producing ultrafine metal hydroxide particles through co-precipitation, the ultrafine metal hydroxide particles are precipitated by changing the pH of a solution containing metal ions.

The aforesaid methods are successful in production of ultrafine particles of a metal oxide or a metal hydroxide, but have a difficulty in low-cost production.

More specifically, it is necessary, in the method involving the hydrolysis of a metal alkoxide, to keep the concentration of the starting material in the solution at a low level during the production of the ultrafine particles for prevention of aggregation of the ultrafine particles. Therefore, a large amount of an alcohol solvent is used, requiring a larger scale production plant. Further, a relatively expensive alkoxide is used as the starting material. Accordingly, the production cost of the ultrafine particles is high.

The method utilizing the plasma-liquid interface involves generation of plasma by electrolysis, resulting in a higher power consumption. Accordingly, the production cost of the ultrafine particles is high.

In the method of co-precipitation, the concentration of metal ions contained in the solution as the starting material of the ultrafine particles is required to be kept at a low level in order to prevent simultaneous development of the core formation and the aggregation of the ultrafine particles. However, this is very difficult to control.

Further, well known methods for producing ultrafine particles of magnetite ($Fe_3O_4$) include reduction of goethite (α-FeOOH) and oxidation of a ferrous salt by addition of an alkali.

JP-A-4-238819 discloses a method of producing ultrafine magnetite particles having particle diameters of 10 to 100 nm, in which an alkali is added to an aqueous solution containing ferrous ions for production of ferrous hydroxide while an inert gas is blown in the aqueous solution for reduction of the concentration of oxygen dissolved therein, and the resulting dispersion is heated up to 60 to 100° C.

However, the magnetite particles produced through the reduction of goethite (α-FeOOH) or through the oxidation of a ferrous salt by addition of an alkali have a relatively large average diameter, i.e., not smaller than 100 nm. The method disclosed in JP-A-4-238819 involves complicated process steps with a difficulty in particle size control for uniformity in particle size and, therefore, are not advantageous in terms of industrial-scale production.

SUMMARY OF THE INVENTION

It is an object of the present invention to provide a method of and an apparatus for producing ultrafine particles of a metal compound such as a metal oxide or a metal hydroxide having particle diameters of not greater than 1 μm with a simpler facility.

As a result of intensive studies to achieve the aforesaid object, the inventors of the present invention have found that, with such an arrangement that an anode and a cathode are provided in an aqueous solution containing a salt of a metal and at least one ion exchange layer is disposed between the anode and the cathode, ions of the metal transferring through the ion exchange layer are precipitated as ultrafine particles of an oxide or hydroxide of the metal when a voltage is applied between the anode and the cathode, thus attaining the present invention.

The method of producing ultrafine metal compound particles in accordance with the present invention comprises the steps of: providing an electrolytic bath having an anode and a cathode and partitioned into chambers by at least one ion exchange layer; providing an electrolytic solution containing metal ions as a starting material for the ultrafine metal compound particles in a chamber on the anodic side of one ion exchange layer; providing an alkaline electrolytic solution in a chamber on the cathodic side of the ion exchange layer; and applying a voltage between the anode and the cathode to cause the metal ions to transfer from the anodic side chamber to the cathodic side chamber through the ion exchange layer, whereby the ultrafine metal compound particles are precipitated in the alkaline electrolytic solution in the cathodic side chamber.

The apparatus for producing ultrafine metal compound particles in accordance with the present invention comprises: an electrolytic bath; an anode and a cathode provided in the electrolytic bath; a power source for applying a voltage between the anode and the cathode; and at least one ion exchange layer provided in the electrolytic bath to partition the electrolytic bath into a chamber on the anodic side of one ion exchange layer which contains an electrolytic solution containing metal ions as a starting material for the ultrafine metal compound particles and a chamber on the cathodic side of the ion exchange layer which contains an alkaline electrolytic solution.

With the method of and the apparatus for producing ultrafine metal compound particles according to the present invention, ultrafine particles having particle diameters of not greater than 1 μm with a sharp particle size distribution can be produced from a less expensive starting material with a simpler facility.

DETAILED DESCRIPTION

Figure 1:
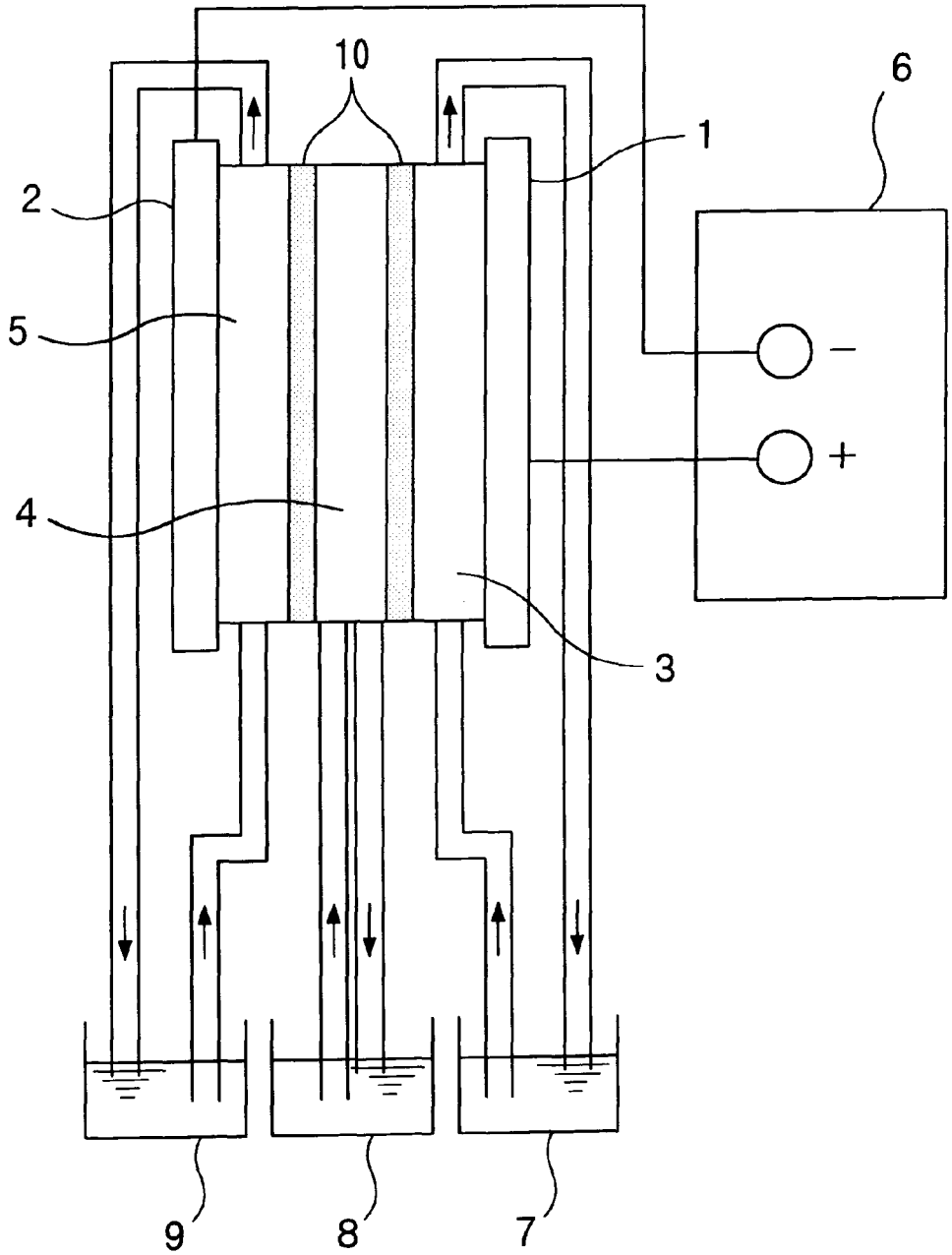
FIG. 1 is a schematic diagram illustrating an apparatus for producing ultrafine metal compound particles in accordance with an embodiment of the present invention.

The present invention will hereinafter be described in detail.

Examples of ultrafine metal compound particles to be obtained by the production method of the present invention include ultrafine particles of a metal oxide, a metal hydroxide, a mixture thereof and a hydrate thereof.

In the present invention, examples of specific metals for the ultrafine metal compound particles include lithium, magnesium, aluminum, calcium, scandium, titanium, vanadium, chromium, manganese, iron, cobalt, nickel, copper, zinc, gallium, germanium, rubidium, strontium, yttrium, zirconium, niobium, molybdenum, ruthenium, rhodium, palladium, cadmium, indium, tin, antimony, tellurium, cesium, barium, tantalum, tungsten, osmium, platinum, gold, mercury, lead, bismuth, cerium, neodymium, samarium and europium, and a plurality of metals selected from these metals may be used in combination.

Among these metals, aluminum, manganese, iron, nickel, zinc and the like are preferred, from which ultrafine particles of aluminum hydroxide, manganese oxide, magnetite ($Fe_3O_4$), maghemite ($\gamma$-$Fe_2O_3$), nickel hydroxide, zinc oxide and the like can be obtained.

The ultrafine metal compound particles obtained in accordance with the present invention have an average particle diameter of 1 to 1000 nm, preferably 5 to 100 nm, with a sharp particle size distribution. The term "particle diameter" herein means the volume average particle diameter of 200 or more particles observed by means of a transmission electron microscope.

In the production method according to the present invention, it is necessary to partition an electrolytic bath by at least one ion exchange layer into a chamber on the anodic side of one ion exchange layer and a chamber on the cathodic side of the ion exchange layer, to provide an electrolytic solution containing metal ions as a starting material for ultrafine metal compound particles in the anodic side chamber, and to provide an alkaline electrolytic solution in the cathodic side chamber.

Ions of any of the aforesaid metals as the material for the ultrafine metal compound particles are contained in the electrolytic solution in the anodic side chamber. The electrolytic solution may further contain electro-conductive ions including anions such as $SO_4^{2-}$, $OH^-$, $CO_3^{2-}$, $NO_3^-$ or $Cl^-$, and cations such as $H^+$, $Na^+$, $K^+$ or $NH_4^+$. Among these ions, $SO_4^{2-}$ which has a low volatility is preferably used.

The electrolytic solution in the anodic side chamber preferably has a concentration of not lower than 0.1 mol/L, more preferably not lower than 1 mol/L. An electrolytic solution of a higher concentration is more preferable because an electric current more easily flows through the electrolytic solution.

The alkaline electrolytic solution in the cathodic side chamber contains cations such as $H^+$, $Na^+$, $K^+$ or $NH_4^+$.

The electrolytic solution in the cathodic side chamber preferably has a pH of 7.5 or higher. A pH range of 8.0 to 13.0 is more preferable, because the solubility of the resulting metal compound can be kept lower for easy precipitation of ultrafine particles of the metal compound. The pH of the electrolytic solution in the cathodic side chamber herein means the pH of the electrolytic solution after the electrolysis is started by application of a voltage. An electrolytic solution which is neutral or acidic before the application of the voltage but becomes alkaline due to the electrolysis may be used as the electrolytic solution in the cathodic side chamber.

The electrolytic solution in the cathodic side chamber preferably has a concentration of not lower than 0.1 mol/L, more preferably not lower than 1 mol/L. An electrolytic solution of a higher concentration is more preferable because an electric current more easily flows through the electrolytic solution.

The ion exchange layer to be used in the present invention is a layer having an ion selective permeability. The ion exchange layer preferably has a low transference number for other ions than the metal ions as the material for the ultrafine particles. More specifically, an ion exchange resin, an ion exchange membrane or the like is used for the ion exchange layer. A fluoro-resin ion exchange membrane is more preferably used which has a low electrical resistance, a chemical resistance and excellent mechanical properties.

At least one ion exchange layer is used to partition the electrolytic bath into the anodic side and cathodic side chambers. Where there is a need for prevention of reactions such as oxidation at the anode and reduction at the cathode and contamination of the electrodes, two or more ion exchange layers may be provided to separate the electrodes from an ultrafine particle production chamber, the starting material solution and the like. Where two ion exchange layers are provided, there are three chambers, i.e., an anode chamber, an intermediate chamber and a cathode chamber, and electrolytic solutions to be contained in the respective chambers may properly be determined. For example, the contamination of the anode and the oxidation of the metal ions can be prevented by providing the electrolytic solution containing the metal ions in the intermediate chamber that is an anodeic side chamber and providing the alkaline electrolytic solution in the cathode chamber that is a cathodic side chamber. Further, the contamination of the cathode can be prevented by providing the electrolytic solution containing the metal ions in the anode chamber that is an anodic side chamber and providing the alkaline electrolytic solution in the intermediate chamber that is a cathodic side chamber.

The anode has a plate shape, a rod shape or a mesh shape, and may be surface-machined or surface-treated to be imparted with a greater surface area. Examples of preferred materials for the anode include metals, non-metals and alloys, such as Ti, carbon and iron. The anode may be entirely or partially coated with Pt, Ir, Ru, Ti, or an oxide thereof. It is preferred that the anode has a chemical resistance. For example, a Ti electrode having a longer service life may be coated with Pt, Ir or an oxide thereof for use as the anode.

The cathode also has a plate shape, a rod shape or a mesh shape, and may be surface-machined or surface-treated to be imparted with a greater surface area, like the anode. Examples of preferred materials for the cathode include metals, non-metals and alloys, such as Ti, carbon and iron. The cathode may be entirely or partially coated with Pt, Ir, Ru, Ti, or an oxide thereof. It is preferred that the cathode has a chemical resistance. A Ti electrode less susceptible to deposition of a solid thereon or a surface-oxidized Ti electrode is preferably used as the anode.

The voltage to be applied between the anode and the cathode affects the structure, composition, average particle diameter, particle size distribution and production rate of the ultrafine particles to be obtained. For enhancement of production efficiency, the voltage to be applied is preferably not lower than 1V, more preferably not lower than 5V. Where a plurality of anodes and cathodes are present, the voltage herein means a voltage to be applied between an anode and a cathode adjoining to each other.

Where ferrous ions are used as the metal ions, an iron compound precipitated in the cathodic side chamber is preferably subjected to further oxidation. Through the oxidation, impurities to be contained in the resulting magnetite can be minimized.

The oxidation is achieved by blowing an oxygen-containing gas such as air, oxygen gas or ozone gas into the electrolytic solution containing the iron compound or bubbling the electrolytic solution with the oxygen-containing gas, or by allowing the electrolytic solution containing the iron compound to flow in the air for exposure to the air. Alternatively, the oxidation may be achieved by adding a liquid oxidizing agent such as hydrogen peroxide, perchloric acid or nitric acid to the electrolytic solution containing the iron compound, by adding a solid oxidizing agent such as manganese dioxide or silver oxide to the electrolytic solution containing the iron compound, or by allowing the electrolytic solution containing the iron compound to pass through a space filled with a solid oxidizing agent. Further, the oxidation of the iron compound may be carried out after collection of the iron compound precipitated in the cathodic side chamber or simultaneously with the precipitation of the iron compound. Among the aforesaid methods, the air blowing or bubbling method and the method of allowing the electrolytic solution containing the iron compound to flow in the air for exposure to the air are preferred because these methods are easy and less costly.

Where the ferrous ions are used as the metal ions, ultrafine magnetite particles are obtained through the aforesaid operation. The ultrafine particles, after being collected by filtration, are heated to be converted into maghemite. The heating temperature is preferably 200° C. to 400° C. If the temperature is lower than 200° C., the conversion to maghemite is incomplete. If the temperature is higher than 400° C., hematite particles are present in a greater proportion in the resulting particles. The heating method is not particularly limited, but heating in the air is preferred in terms of costs.

The magnetite particles are preferably dried at a temperature of not higher than 100° C. before the heating for prevention of aggregation and growth of the ultrafine particles which may otherwise occur due to rapid oxidation. The drying is carried out under a reduced or normal pressure in a dry atmosphere.

The apparatus for producing ultrafine metal compound particles in accordance with the present invention includes an electrolytic bath, an anode and a cathode provided in the electrolytic bath, a power source for applying a voltage between the anode and the cathode, and at least one ion exchange layer provided in the electrolytic bath to partition the electrolytic bath into a chamber on the anodic side of one ion exchange layer which contains an electrolytic solution containing metal ions as a starting material for the ultrafine metal compound particles and a chamber on the cathodic side of the ion exchange layer which contains an alkaline electrolytic solution.

In accordance with the present invention, the ultrafine metal compound particles may be produced in a batch with the use of a single electrolytic bath. For mass production of the ultrafine metal compound particles, the apparatus to be employed may be constructed such that electrolytic solution reservoirs which respectively communicate with the chambers of the electrolytic bath are provided outside the electrolytic bath to continuously supply the electrolytic solutions to the respective chambers by means of pumps or the like and the resultant electrolytic solution containing ultrafine particles are continuously recovered.

The ultrafine metal compound particles obtained in accordance with the present invention are expected to be useful in various applications, for example, as materials such as magnetic materials for electronic devices.

Description of the Preferred Embodiments

The present invention will hereinafter be described in greater detail by way of examples thereof.

EXAMPLE 1

With the use of an apparatus as shown in FIG. 1, ultrafine magnetite particles were produced.

A titanium plate electrode having an iridium oxide coating formed on a surface thereof in contact with an electrolytic solution was used as an anode 1, and a titanium electrode was used as a cathode 2. The anode 1 and the cathode 2 were connected to a direct current power source 6. A 30-L electrolytic bath was partitioned into three chambers, i.e., an anode chamber 3, an intermediate chamber 4 that is an anodic side chamber and a cathode chamber 5 that is a cathodic side chamber, by two cation exchange membranes 10 available under the trade name of NAFION from E. I. du Pont de Nemours & Co. Electrolytic solutions were respectively supplied to the chambers 3, 4 and 5 from corresponding external auxiliary chambers 7, 8 and 9, and circulated by means of pumps.

Contained in the cathode auxiliary chamber 9 was 100 L of an alkaline electrolytic solution of pH 10 obtained by adding a small amount of sodium hydroxide to a 1 mol/L sodium sulfate aqueous solution. Contained in the intermediate auxiliary chamber 8 was 100 L of a 1 mol/L ferrous sulfate aqueous solution containing ferrous ions as a starting material for the ultrafine magnetite particles. Contained in the anode auxiliary chamber 7 was 100 L of a 1 mol/L sulfuric acid aqueous solution. The electrolytic solutions in the respective auxiliary chambers 7, 8, 9 were kept at 30° C. The electrolytic solutions were respectively supplied from the auxiliary chambers 7, 8 and 9 to the chambers 3, 4 and 5, and thoroughly circulated by means of the pumps. Then, a voltage of 30V was applied between the electrodes by the direct current power source 6 for electrolysis for 8 hours.

As a result, black ultrafine magnetite particles produced in the cathode chamber 5 were collected in the cathode auxiliary chamber 9. The ultrafine magnetite particles thus obtained were separated with the use of an electromagnet, then thoroughly rinsed with water, and freeze-dried. The dry weight of the particles was 1.1 kg.

Figure 2:
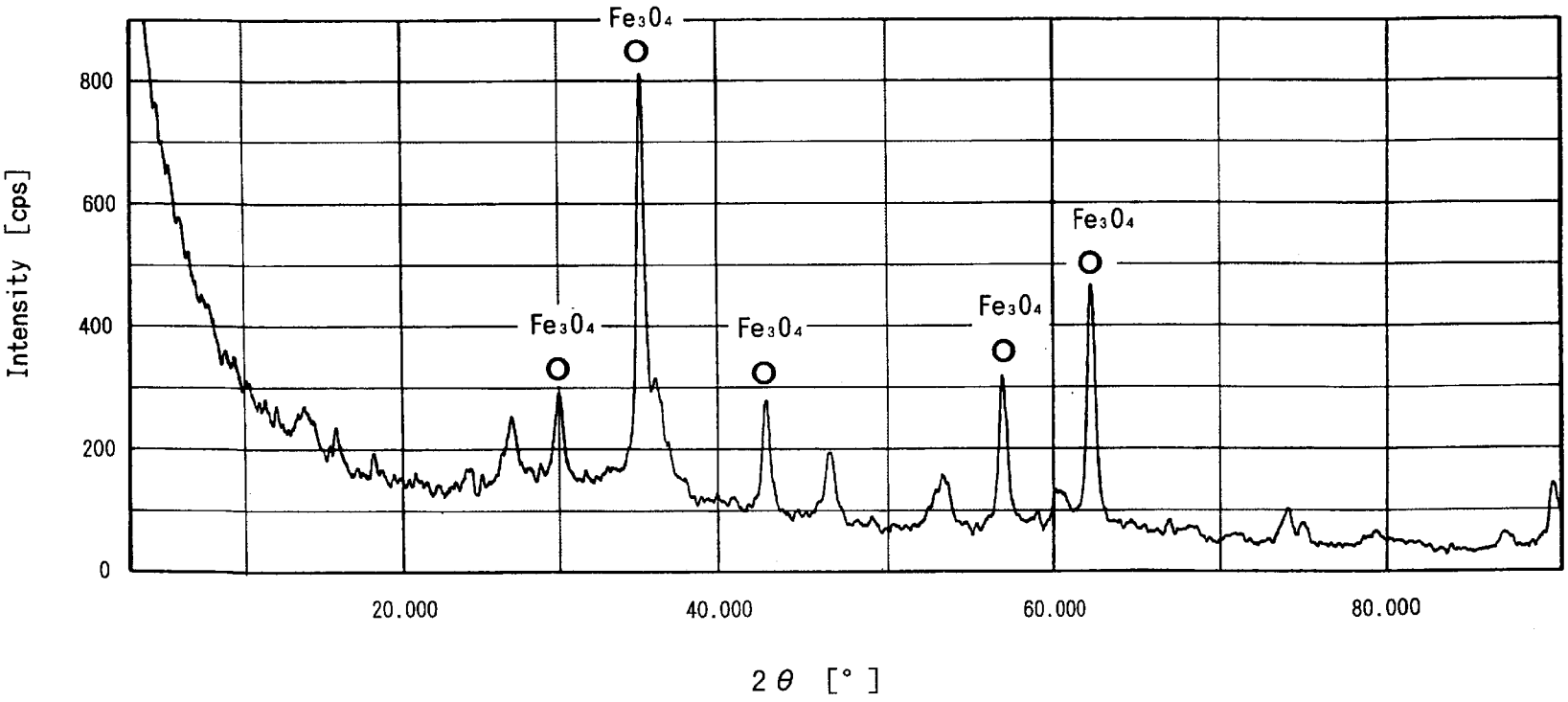
FIG. 2 shows the result of the X-ray diffraction analysis of ultrafine magnetite particles obtained in Example 1 of the invention.
Figure 3:
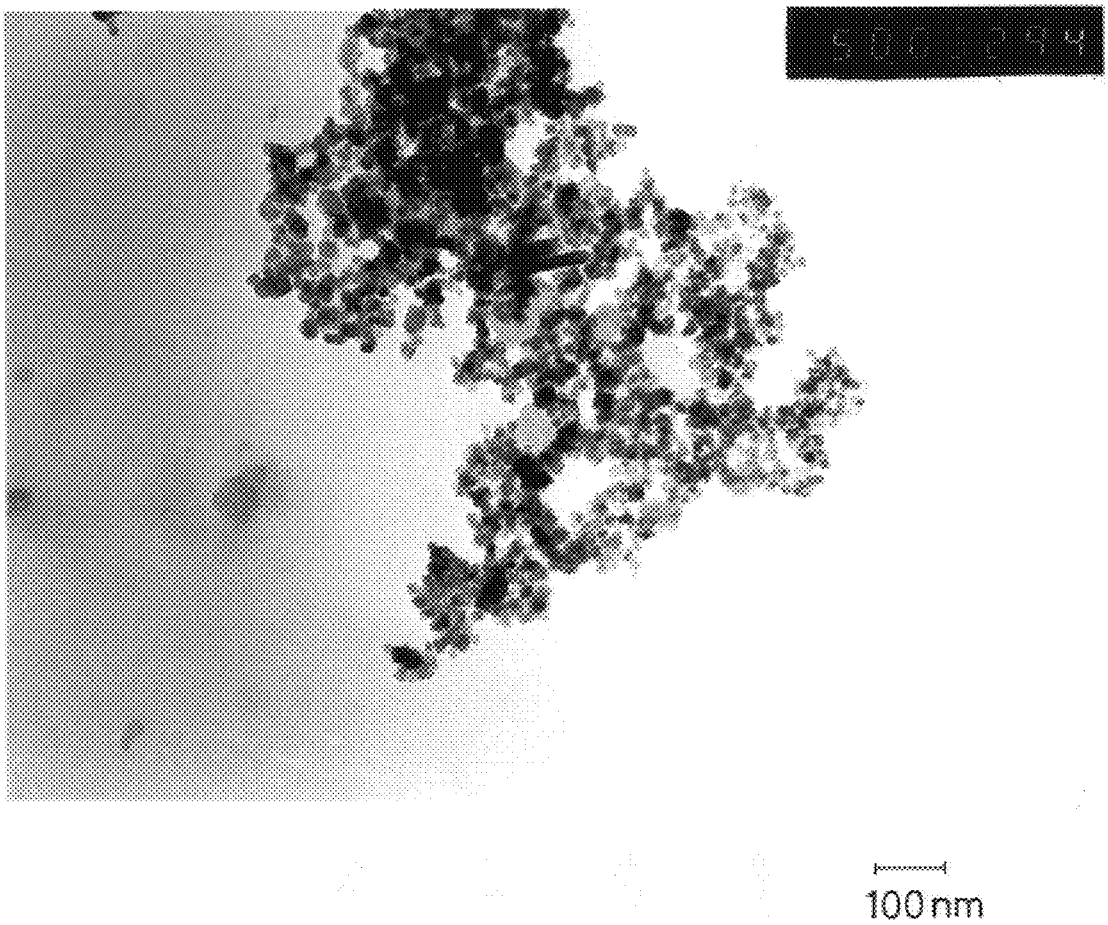
FIG. 3 shows a transmission electron microscopic photograph of the ultrafine magnetite particles obtained in Example 1 of the invention.

FIG. 2 shows the result of the X-ray diffraction analysis of the ultrafine magnetite particles. In FIG. 2, peaks indicated by circles represent magnetite, proving that the obtained ultrafine particles were mainly composed of magnetite. FIG. 3 shows a photograph of the ultrafine magnetite particles taken by a transmission electron microscope (JEM-200CX, JEOL Co.). It was confirmed from FIG. 3 that the ultrafine particles had primary particle diameters of about 20 nm.

EXAMPLE 2

A titanium plate electrode coated with iridium oxide was used as an anode, and a titanium plate electrode was used as a cathode. An electrolytic bath (volume: 300 ml) was partitioned into two chambers by a single cation exchange membrane available under the trade name of NAFION from E. I. du Pont de Nemours & Co. Without the use of the external auxiliary chambers shown in FIG. 1, only the solutions contained in the electrolytic bath were used for the reaction. Contained in the anodic side chamber was 100 mL of a 1 mol/L ferrous sulfate aqueous solution containing metal ions as a starting material for ultrafine particles. Contained in the cathodic side chamber was 100 mL of an alkaline electrolytic solution of pH 10 obtained by adding a small amount of sodium hydroxide to a 1 mol/L sodium sulfate aqueous solution. A voltage of 10V was applied between the electrodes for electrolysis for 6 hours. As a result, 7.2 g of black ultrafine magnetite particles having an average particle diameter of 20 nm were obtained in the cathodic side chamber, which were attracted to a magnet.

EXAMPLE 3

An apparatus as used in Example 2 was used. Contained in the anodic side chamber was 100 mL of a 1 mol/L zinc sulfate aqueous solution containing metal ions as a starting material for ultrafine particles. Contained in the cathodic side chamber was 100 mL of an alkaline electrolytic solution of pH 10 obtained by adding a small amount of sodium hydroxide to a 1 mol/L sodium sulfate aqueous solution. A voltage of 10V was applied between the electrodes by a direct current power source for electrolysis for 6 hours.

As a result, 5.2 g of white ultrafine zinc oxide particles having an average particle diameter of 30 nm were obtained in the cathodic side chamber.

EXAMPLE 4

With the use of an apparatus as used in Example 1, electrolysis was carried out in substantially the same manner as in Example 1 by application of a voltage, except that a 0.5 mol/L nickel sulfate aqueous solution was contained in the intermediate auxiliary chamber 8.

Figure 4:
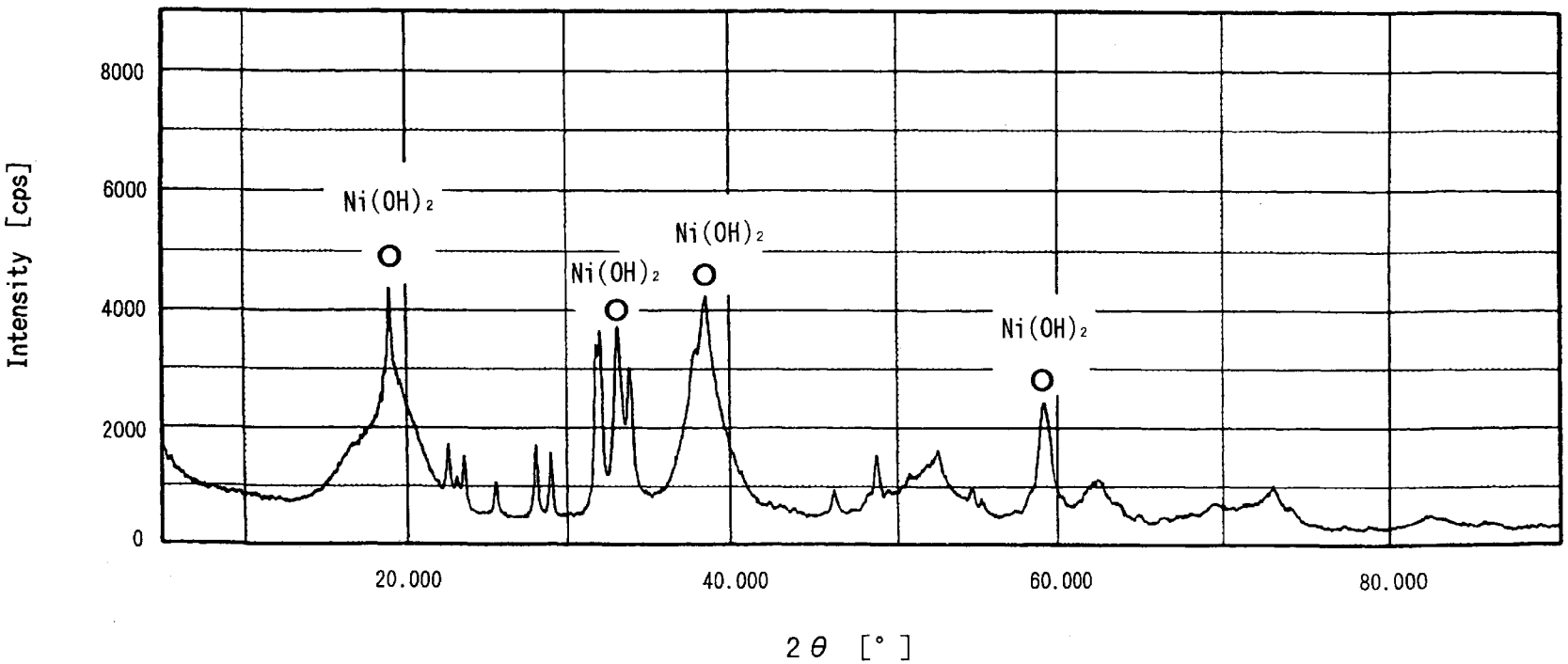
FIG. 4 shows the result of the X-ray diffraction analysis of ultrafine nickel hydroxide particles obtained in Example 4 of the invention.
Figure 5:
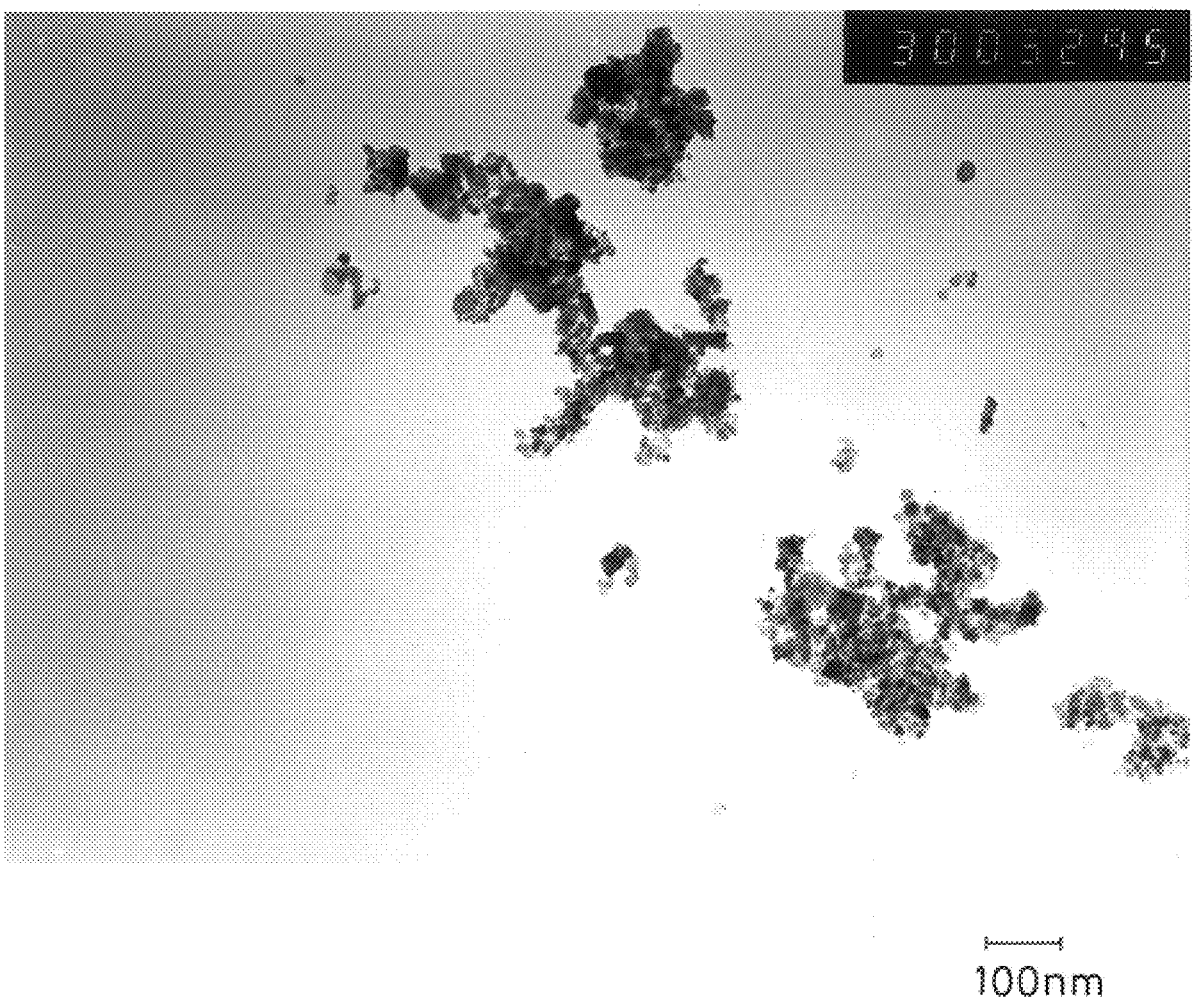
FIG. 5 shows a transmission electron microscopic photograph of the ultrafine nickel hydroxide particles obtained in Example 4 of the invention.

As a result, greenish white ultrafine particles produced in the cathode chamber 5 were collected in the cathode auxiliary chamber 9. The ultrafine particles thus obtained were rinsed with water by a centrifugal separation technique for removal of salt components, and then freeze-dried. The dry weight of the particles was 0.5 kg. FIG. 4 shows the result of the X-ray diffraction analysis of the ultrafine particles. It was confirmed on the basis of diffraction peaks indicated by circles in FIG. 4 that the ultrafine particles were composed of nickel hydroxide. FIG. 5 shows a photograph of the ultrafine nickel hydroxide particles taken by a transmission electron microscope (JEM-200CX, JEOL Co.). The photograph indicates that the ultrafine particles had an average particle diameter of 30 nm.

EXAMPLE 5

With the use of an apparatus as used in Example 2, electrolysis was carried out in substantially the same manner as in Example 2 by application of a voltage, except that a 0.2 mol/L aluminum sulfate aqueous solution was contained in the anodic side chamber.

As a result, 4.1 g of white ultrafine aluminum hydroxide particles having an average diameter of 40 nm were obtained in the cathodic side chamber.

EXAMPLE 6

With the use of an apparatus as used in Example 1, ultrafine magnetite particles were produced. However, cation exchange membranes 10 were replaced with cation exchange membranes described below.

More specifically, a titanium plate electrode having an iridium oxide coating formed on a surface thereof in contact with an electrolytic solution was used as an anode 1, and a titanium electrode was used as a cathode 2. A 30-L electrolytic bath was partitioned into three chambers, i.e., an anode chamber 3, an intermediate chamber 4 that is an anodic side chamber, and a cathode chamber 5 that is a cathodic side chamber, by two cation exchange membranes 10 available under the trade name of SELEMION CMV from Asahi Glass Co. Ltd. Electrolytic solutions were respectively supplied to the chambers 3, 4 and 5 from corresponding external auxiliary chambers 7, 8 and 9, and circulated by means of pumps.

Contained in the cathode auxiliary chamber 9 was 100 L of an alkaline electrolytic solution of pH 10 obtained by adding a small amount of sodium hydroxide to a 1 mol/L sodium sulfate aqueous solution. Contained in the intermediate auxiliary chamber 8 was 100 L of a 1 mol/L ferrous sulfate aqueous solution containing ferrous ions as a starting material for the ultrafine magnetite particles. Contained in the anode auxiliary chamber 7 was 100 L of a 1 mol/L sulfuric acid aqueous solution. The electrolytic solutions were respectively supplied from the auxiliary chambers 7, 8 and 9 to the chambers 3, 4 and 5, and thoroughly circulated by means of the pumps. Then, a current of 100 A was passed between the electrodes 1 and 2 for 8 hours by a direct current power source 6. At this time, the cathode electrolytic solution was kept at pH 10 with the use of 1 mol/L sulfuric acid and 1 mol/L NaOH by means of an automatic pH titrator. The temperature of the cathode electrolytic solution was kept at 40° c. Further, the cathode electrolytic solution was bubbled with air at a flow rate of 2 L/min in the cathode auxiliary chamber 7 by means of an air pump for sufficient oxidation.

Figure 6:
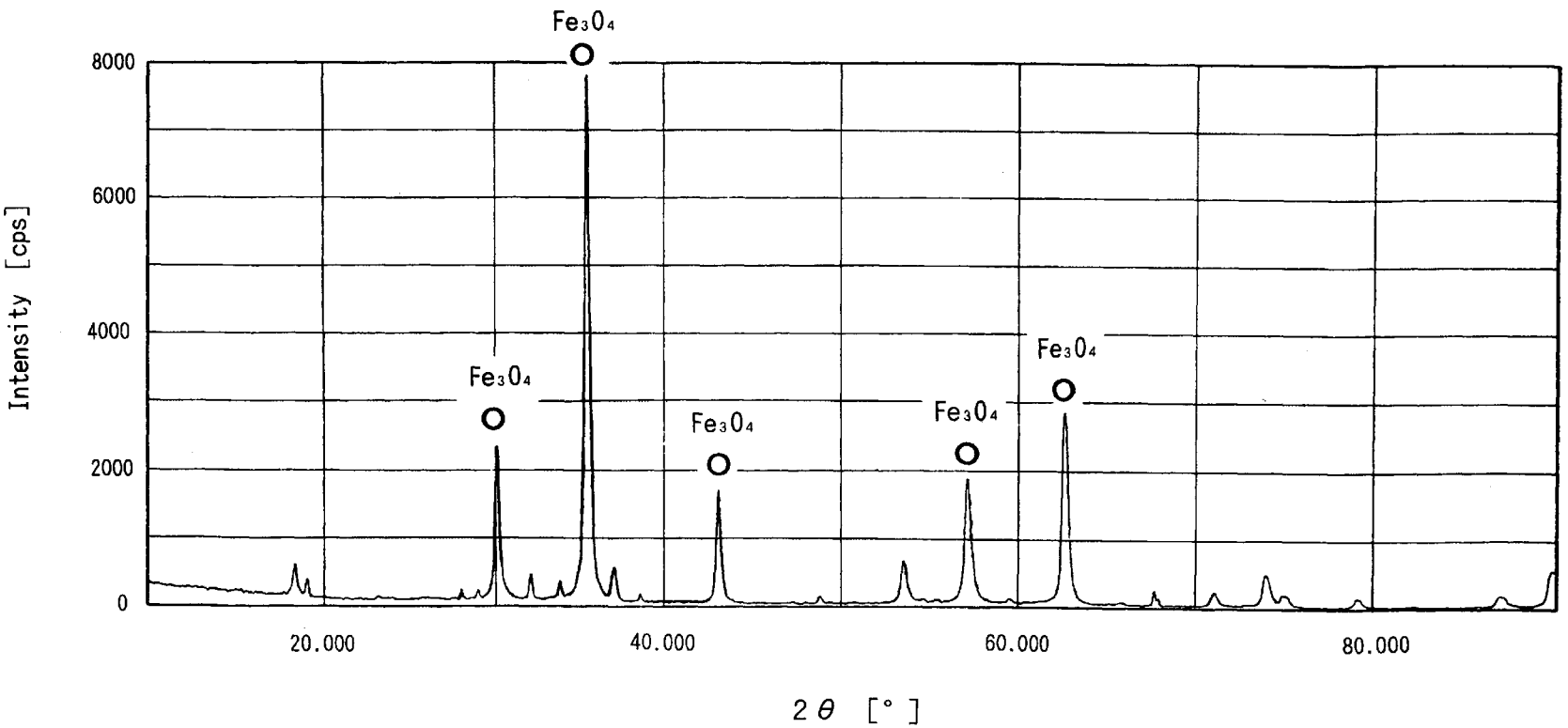
FIG. 6 shows the result of the X-ray diffraction analysis of ultrafine magnetite particles obtained in Example 6 of the invention.
Figure 7:
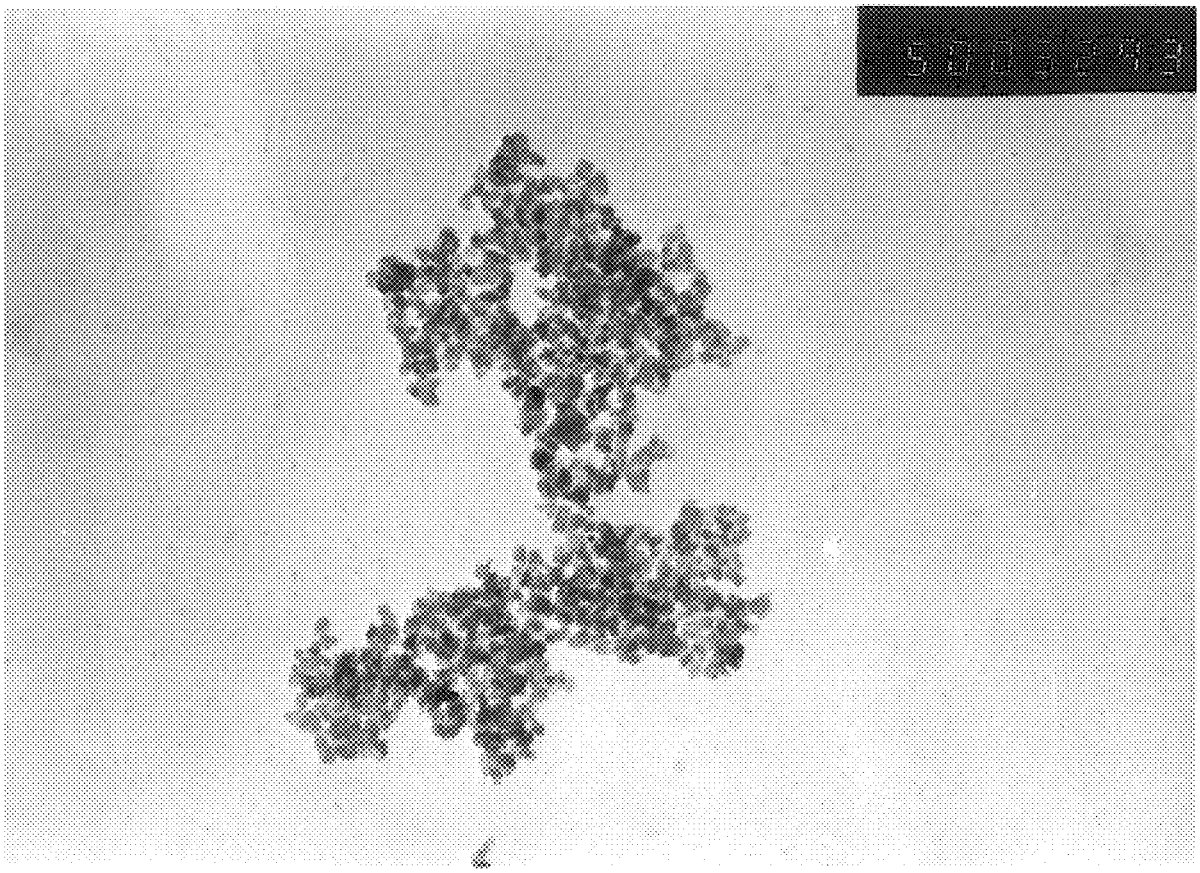
FIG. 7 shows a transmission electron microscopic photograph of the ultrafine magnetite particles obtained in Example 6 of the invention.

As a result, a black slurry was obtained in the cathode auxiliary chamber 9. The slurry was filtered and rinsed with water by an ordinary method, and dried in vacuo at 40° C. for 48 hours. The yield was 1.5 kg. The X-ray diffraction analysis (peaks indicated by circles in FIG. 6 represent magnetite) and a photograph (FIG. 7) taken by an electron microscope (JEM-200CX, JEOL Co.) show that the ultrafine particles thus obtained were ultrafine magnetite particles having an average particle size of 30 nm. Further, FIG. 7 shows that impurities other than magnetite were present in a very small amount in the ultrafine particles.

EXAMPLE 7

Figure 8:
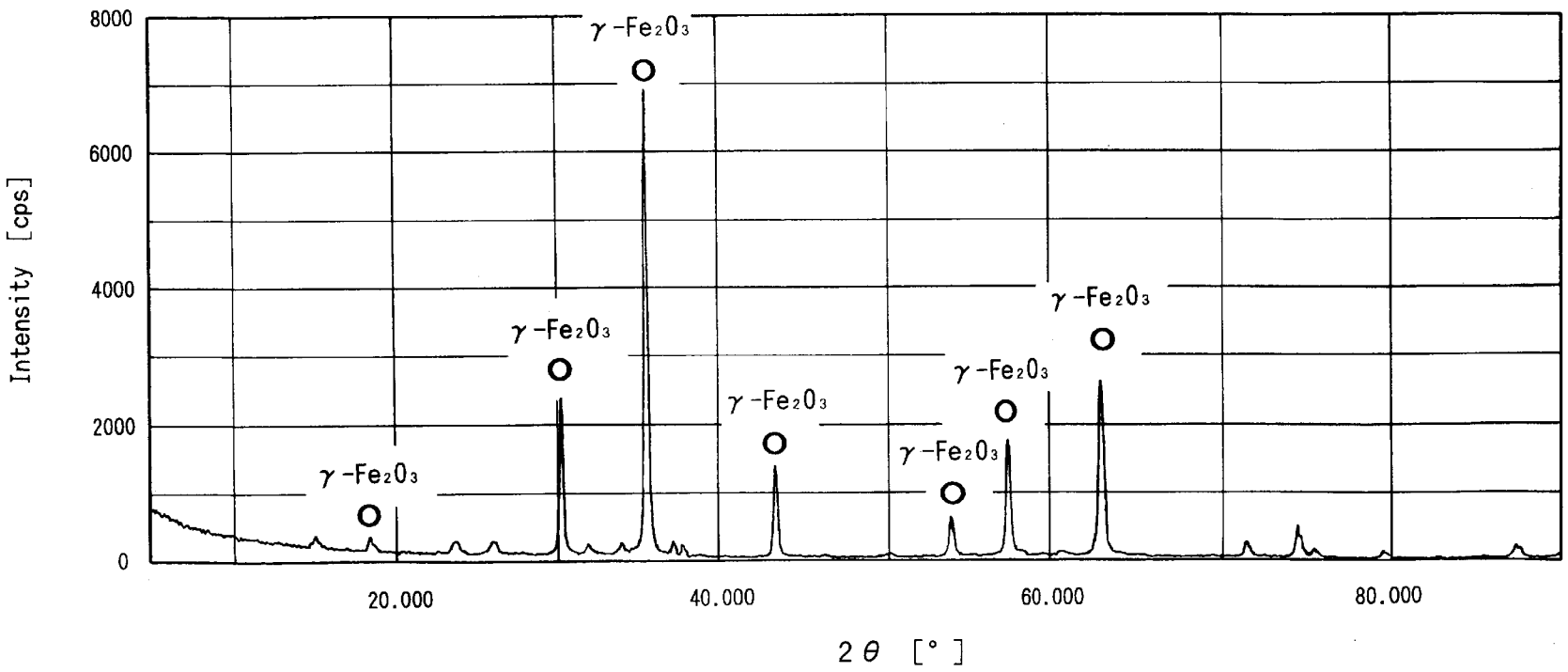
FIG. 8 shows the result of the X-ray diffraction analysis of ultrafine maghemite particles obtained in Example 7 of the invention.
Figure 9:
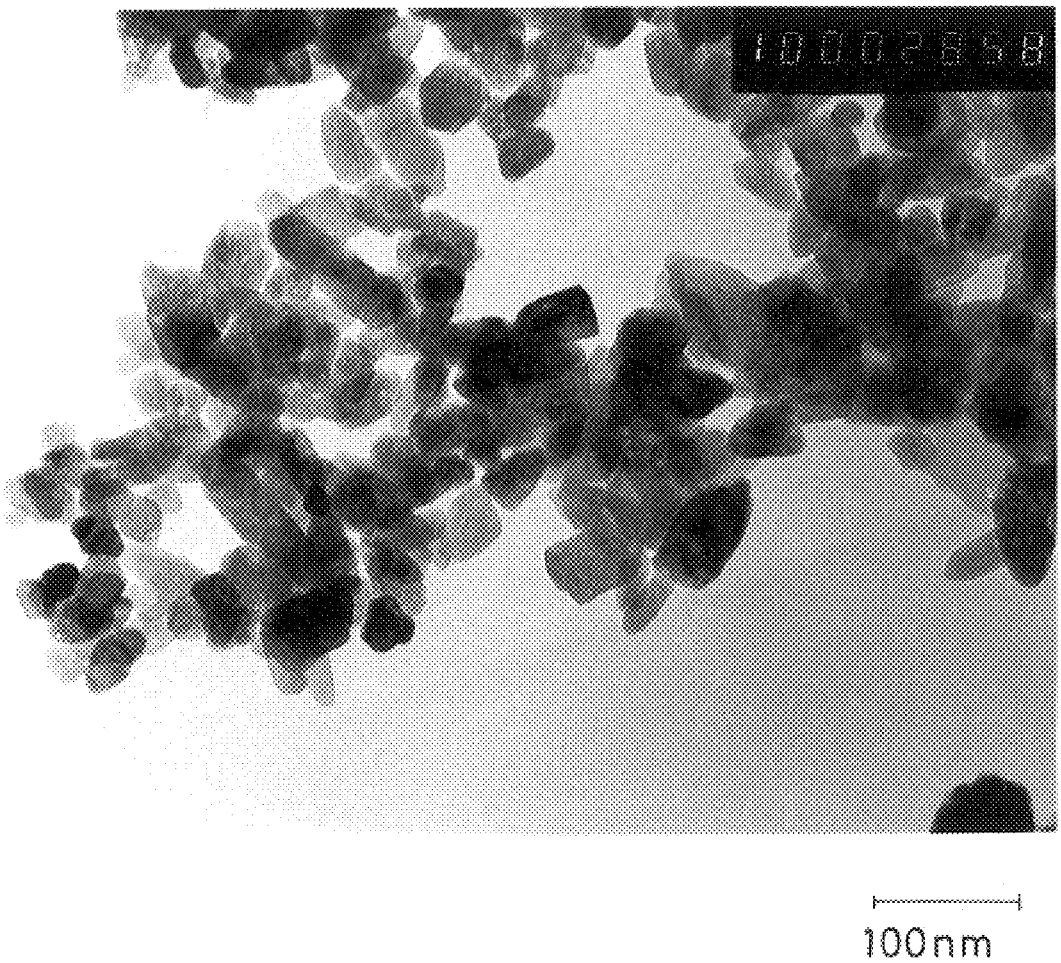
FIG. 9 is a transmission electron microscopic photograph of the ultrafine maghemite particles obtained in Example 7 of the invention.

The black slurry produced in the cathode auxiliary chamber 9 in Example 6 was filtered and rinsed with water by an ordinary method, and dried in vacuo at 40° C. for 48 hours. The resulting particles were heated at 300° C. for 2 hours. Thus, 1.6 kg of dark brown powder was obtained. The X-ray diffraction analysis (peaks indicated by circles in FIG. 8 represent maghemite) and a photograph (FIG. 9) taken by an electron microscope (JEM-200CX, JEOL Co.) show that the powder thus obtained was ultrafine maghemite particles having an average particle size of 30 nm.

What is claimed is:

1. A method of producing ultrafine particles of a metal oxide, comprising the steps of:

providing an electrolytic bath having an anode and a cathode and partitioned into chambers by at least one ion exchange layer;

providing an electrolytic solution containing metal ions as a starting material for the ultrafine metal oxide particles in a chamber on the anodic side of one ion exchange layer;

providing an alkaline electrolytic solution in a chamber on the cathodic side of the ion exchange layer; and applying a voltage between the anode and the cathode to cause the metal ions to transfer from the anodic side chamber to the cathodic side chamber through the ion exchange layer, whereby the ultrafine metal oxide particles having diameters of not greater than 1 $\mu$m are precipitated in the alkaline electrolytic solution in the cathodic side chamber.

2. A production method as set forth in claim 1, wherein the ultrafine metal oxide particles are ultrafine zinc oxide particles.

3. A production method as set forth in claim 1, wherein the alkaline electrolytic solution in the cathodic side chamber has a pH of 8.0 to 13.0.

4. An apparatus for producing ultrafine metal oxide particles, comprising:

an electrolytic bath;

an anode and a cathode provided in the electrolytic bath;

a power source for applying a voltage between the anode and the cathode; and at least one ion exchange layer provided in the electrolytic bath to partition the electrolytic bath into a chamber on the anodic side of one ion exchange layer which contains an electrolytic solution containing metal ions as a starting material for the ultrafine metal oxide particles having diameters of not greater than 1 $\mu$m and a metal oxide precipitation chamber on the cathodic side of the ion exchange layer which contains an alkaline electrolytic solution.

5. An apparatus as set forth in claim 4, further comprising electrolytic solution reservoirs which are provided outside the electrolytic bath and respectively communicate with the chambers of the electrolytic bath.

6. An ultrafine megnetite particle production method, comprising the steps of:

providing an electrolytic bath having an anode and a cathode partitioned into chambers by at least one ion exchange layer;

providing an electrolytic solution containing ferrous ions in a chamber on the anodic side of one ion exchange layer;

providing an alkaline electrolytic solution in a chamber on the cathodic side of the ion exchange layer;

applying a voltage between the anode and the cathode to cause the ferrous ions to transfer from the anodic side chamber to the cathodic side chamber through the ion exchange layer, whereby an iron compound is precipitated in the alkaline electrolytic solution in the cathodic side chamber;

oxidizing the precipitated iron compound, thereby obtaining ultrafine magnetite particles having diameters of not greater than 1 $\mu$m.

7. An ultrafine magnetite particle production method as set forth in claim 6, wherein the alkaline electrolytic solution in the cathodic side chamber has a pH of 8.0 to 13.0.

8. An ultrafine maghemite particle production method, comprising the steps of:

providing an electrolytic bath having an anode and a cathode partitioned into chambers by at least one ion exchange layer;

providing an electrolytic solution containing ferrous ions in a chamber on the anodic side of one ion exchange layer;

providing an alkaline electrolytic solution in a chamber on the cathodic side of the ion exchange layer;

applying a voltage between the anode and the cathode to cause the ferrous ions to transfer from the anodic side chamber to the cathodic side chamber through the ion exchange layer, whereby an iron compound is precipitated in the alkaline electrolytic solution in the cathodic side chamber;

oxidizing the precipitated iron compound; and heating the oxidized iron compound, thereby obtaining ultrafine maghemite particles having diameters of not greater than 1 $\mu$m.

9. An ultrafine maghemite particle production method as set forth in claim 8, wherein the heating is carried out at a temperature of 200° C. to 400° C.

10. An ultrafine maghemite particle production method as set forth in claim 8, further comprising the step of drying the oxidized iron compound prior to the heating step.

11. An ultrafine maghemite particle production method as set forth in claim 10, wherein the drying is carried out at a temperature of not higher than 100° C.

12. An ultrafine maghemite particle production method as set forth in claim 8, wherein the alkaline electrolytic solution in the cathodic side chamber has a pH of 8.0 to 13.0.

* * * * *